US006142160A

United States Patent [19]

Winslow et al.

[11] Patent Number: 6,142,160

[45] Date of Patent: Nov. 7, 2000

[54] METHOD FOR DISPERSING AND REMOVING SLUDGE CONTAINED IN A STORAGE TANK

[75] Inventors: M. Craig Winslow, Houston, Tex.; Larry J. Weber, Caseyville, Ill.

[73] Assignee: BetzDearborn Inc., Trevose, Pa.

[21] Appl. No.: 09/316,680

[22] Filed: May 21, 1999

[51] Int. Cl.[7] ..... B08B 9/00; B08B 9/20

[52] U.S. Cl. ..... 134/22.1; 134/22.18; 134/24; 134/168 R

[58] Field of Search ..... 134/22.1, 22.18, 134/24, 167 R, 168 R

[56] References Cited

U.S. PATENT DOCUMENTS

| | | | |
|---|---|---|---|
| 3,095,001 | 6/1963 | Steltz | 134/167 R |
| 4,406,796 | 9/1983 | Duval . | |
| 4,925,496 | 5/1990 | Stouky et al. | 134/167 R |
| 4,945,933 | 8/1990 | Krajicek et al. | 134/167 R |
| 5,008,035 | 4/1991 | Broom . | |
| 5,091,016 | 2/1992 | Krajicek et al. . | |
| 5,176,838 | 1/1993 | Chin et al. . | |
| 5,445,173 | 8/1995 | Aiken | 134/167 R |
| 5,518,553 | 5/1996 | Moulder . | |
| 5,561,883 | 10/1996 | Landry et al. . | |
| 5,582,652 | 12/1996 | Robertson et al. . | |
| 5,788,850 | 8/1998 | Tuomey | 134/168 R |
| 5,876,512 | 3/1999 | Desormeaux et al. . | |
| 6,021,787 | 2/2000 | Luke | 134/22.1 |

*Primary Examiner*—Randy Gulakowski
*Assistant Examiner*—Saeed Chaudhry
*Attorney, Agent, or Firm*—Steven D. Boyd

[57] ABSTRACT

A method and apparatus for cleaning the interior of the storage tanks of the type used for storing large volumes of liquids, such as crude oil, wherein hydrocarbon sludge accumulates with the passage of time, such apparatus comprising concentric hallow pipes, a spray nozzle for injecting a flushing fluid, and connecting means including a packing gland which allows the concentric pipes to be movably oriented inside a storage tank through a manway. With this construction, a flushing fluid can be sprayed into a sludge layer in the storage tank through the inner pipe and sludge/flushing fluid withdrawn through the annular region between the concentric pipes. The packing gland in the connecting means, and a second packing gland between the inner and outer pipes allows for independent movement of the pipes within the storage tank.

1 Claim, 4 Drawing Sheets

100
102
104
106
108
110
112
113
116
118
200
201
208
530

100
102
106
108
110
112
118
200
500
502
530

METHOD FOR DISPERSING AND REMOVING SLUDGE CONTAINED IN A STORAGE TANK

FIELD OF THE INVENTION

The present invention relates to a novel method and apparatus for the dispersion and removal of sediment, such as hydrocarbon sludge from a storage tank. More particularly, the present invention relates to a method and apparatus for cleaning the interior of hydrocarbon storage tanks of the type used in petroleum refineries, chemical plants and the like for storing large volumes of hydrocarbon liquids wherein solid materials (composed principally of hydrocarbons) and normally referred to as "hydrocarbon sludge" accumulate with the passage of time.

Still more particularly, the present invention relates to novel apparatus for dispersing and removing accumulated sediments, such as hydrocarbon sludge in a storage tank, such apparatus comprising an inner hollow pipe with nozzle outlet means mounted at one end. An outer hollow pipe is concentrically oriented around the inner hollow pipe forming an open annular space there between. The concentric pipes are inserted into a hydrocarbon storage tank through an isolation barrel having a packing gland at one end and a gate valve leading to the interior of the hydrocarbon storage tank at the other end. The inner pipe is connected to a source of pressurized flushing fluid. The open annular space is open to the interior of the hydrocarbon storage tank at an end, adjacent to the nozzle outlet of the inner pipe, and open, through an outlet valve, to a sludge disposal system at the other end. The inner pipe can be moved longitudinally, independently of movement of the concentric outer pipe.

With this construction, an appropriate pump means may be provided for forcing a flushing fluid, such as a hydrocarbon/dispersant mixture, through the inner pipe, through the nozzle means, into the sludge layer in a hydrocarbon storage tank. The spray of flushing fluid redisperses the sludge layer. A suction pump means pulls the redispersed sludge through the open annular region between the inner and outer pipes through a drain valve and to appropriate disposal or treatment means.

A flexible joint in the isolation barrel allows the nozzle and the concentric pipes in the hydrocarbon storage tank to be manipulated so as to access a large area inside the hydrocarbon storage tank. Independent longitudinal movement of the inner and outer pipes allows the open end, which withdraws the sludge, of the outer pipe to be separated from the nozzle end of the inner pipe which sprays the flushing fluid into the sludge layer.

The inner and outer concentric pipes can be segmented into pipe joints; however, in a preferred embodiment, the inner and outer concentric pipes are welded or formed as a single segment of the desired length. Typically, the inner and outer concentric pipes can be of from 20 to 40, up to 100 feet in length. The overall length of the inner and outer pipes is selected so as to allow a significant area within the hydrocarbon storage tank to be exposed to the flushing fluid spray. This may be accomplished with "shorter" concentric pipe lengths and multiple access ports spaced around the circumference of the tank.

In accordance with one embodiment of the present invention, a gate valve and an isolation barrel are fixed to a manway in the side of a storage tank such as a storage tank of the type used to store crude oil. Representative crude oil storage tanks have a diameter of about 100 to about 300 feet and a height of about 20 to 50 feet. Hydrocarbon sludge will settle from the stored crude oil with the passage of time such that the bottom of a crude oil storage tank may contain an accumulation of about 1 to about 10 feet of hydrocarbon sludge. In accordance with an embodiment of the present invention, an isolation barrel is mounted on the gate valve, the isolation barrel preferable includes a flexible joint. The isolation barrel is provided with a tubular packing gland in the closed rear end thereof. With the gate valve closed, the isolation barrel is mounted on the gate valve. The first joint of concentric pipes may be inserted into the isolation barrel through the packing gland. The gate valve may then be opened to allow access to the interior of the storage tank by the concentric pipes. The front end of the inner pipe terminates in a sprayer means. The front end of the outer pipe is opened thereby allowing the hydrocarbon sludge to flow through the open annular region between the inner and outer pipes. The concentric pipes are inserted to allow the front end of the inner pipe to be inserted into the storage tank a desired distance. The flexible coupling in the isolation barrel allows the orientation of the front end of the concentric pipes to be manipulated in the horizontal and vertical planes within the storage tank.

In further accordance with this embodiment, the rear end of the outer pipe is terminated with a fitting including an outlet controlled by a valve to allow fluid flow and an axially-oriented packing gland through which the inner pipe extends. The inner pipe is terminated with an appropriate fitting to connection to a pump means. When connected to a pump means, a flushing fluid can be injected into the hydrocarbon sludge layer through the inner pipe. The flushing fluid redisperses and/or solubilizes the hydrocarbon sludge which is then removed from the storage tank through the open annular region between the inner and outer pipes. Connection of the suction side of a pump to the outlet on the rear end of the outer pipe will remove the redispersed/solubilized sludge from the storage tank for treatment or dispersal. The flow of flushing fluid through the inner pipe can be at a pressure of from about 20 psig to about 450 psig and at a volume of from about 20 gallons per minute up to 1000 gallons per minute.

In further accordance with the preferred embodiment of the present invention, a hydraulic drive is oriented adjacent the crude oil storage tank in lateral axial alignment with the isolation barrel. The hydraulic drive comprises an elongated frame, reciprocation means carried by the frame for movement backward and forward along the frame, and pipe gripping means whereby the concentric pipes, with spray means on the inner pipe can be extended through the packing gland into the crude oil storage tank. The hydraulic drive is provided with means to move up and down vertically to thereby move the first pipe joint, inside the crude oil storage tank, up and down vertically. The hydraulic drive also includes means to move the interconnected pipe joints back and forth horizontally to thereby move the first pipe joint back and forth horizontally inside the crude oil storage tank. Such movement of the concentric pipes is facilitated by a flexible coupling in the isolation drum.

Additional modifications, embodiments and advantages of the present invention will be hereinafter described in greater detail.

BACKGROUND OF THE INVENTION

It is common commercial practice to store liquid materials in storage tanks. Typically, for many industrial applications, storage tanks will have a diameter from 100 to 300 feet and heights of 20 to 50 feet or more. The liquids stored in such storage tanks are diverse. For example, water or aqueous solutions of organic or inorganic chemicals may be stored in this manner, derivatives of agricultural products such as vegetable oils which are water soluble are likewise stored in this manner.

More commonly, however, large volume storage tanks of this nature are used in the production, collection and refining of crude oils and derivatives thereof such as crude oils containing naphthenic and aromatic components and refinery products such as gasolines, diesel fuels, jet fuels, fuel oils, kerosene, gas oils etc. and petrochemical derivatives such as benzene, xylenes, toluene, etc.

With the passage of time, solid materials, usually in finely divided form, will accumulate in the storage tank and settle at the bottom thereof. When the accumulation becomes excessive, it must be removed from the storage tank.

One manner in which this can be accomplished is to drain the tank and manually remove the sediments that are deposited therein. However, such a procedure is costly and time-consuming and can cause the workmen involved therein to be exposed to hazardous or potentially hazardous materials.

The problem of sediment accumulation is particularly accentuated insofar as the storage of crude oil and, in particular, aromatic and naphthenic crude oils is concerned. Such crude oils as introduced into the storage tank will normally contain aromatic, naphthenic and asphaltic components which are believed to be potentially reactive and/or condensable with each other. Moreover, a minor amount of water will normally be present in the crude oil (e.g., about 0.1 to 5 wt. %), but usually the water will not be present as a separate phase, but rather as small droplets of water emulsified to ionizable components of the crude oil, such as asphaltenes.

It is believed that molecular charge transfer forces, such as Van Der Waals forces, cause many of the molecular aromatics, naphthenic and asphaltic components of the crude oil to agglomerate and weakly bond to each other to form aggregates having a size sufficient to cause them to precipitate from the crude oil and settle at the bottom of a crude oil storage tank together with the emulsified water droplets to that the resultant "hydrocarbon sludge" will normally comprise highly aromatic components such as poly aromatic components in which a significant portion of the water (in the form of emulsified droplets) will be accumulated. Such sediment in the bottom of crude oil storage tanks is colloquially referred to as black sediment and water or hydrocarbon sludge or just plain sludge.

The hydrocarbon sludge that accumulates, as such, is of marginal economic value and, if manually removed usually represents a disposal problem.

It is known to remove sediments from a storage tank by agitating the liquid in the storage tank so as to resuspend the sediment so that a stream of sediment-containing liquid can be withdrawn from the storage tank and filtered as illustrated for example by Krajicek et al., U.S. Pat. No. 5,091,016.

DETAILED DESCRIPTION OF THE PREFERRED EMBODIMENT

Figure 1:
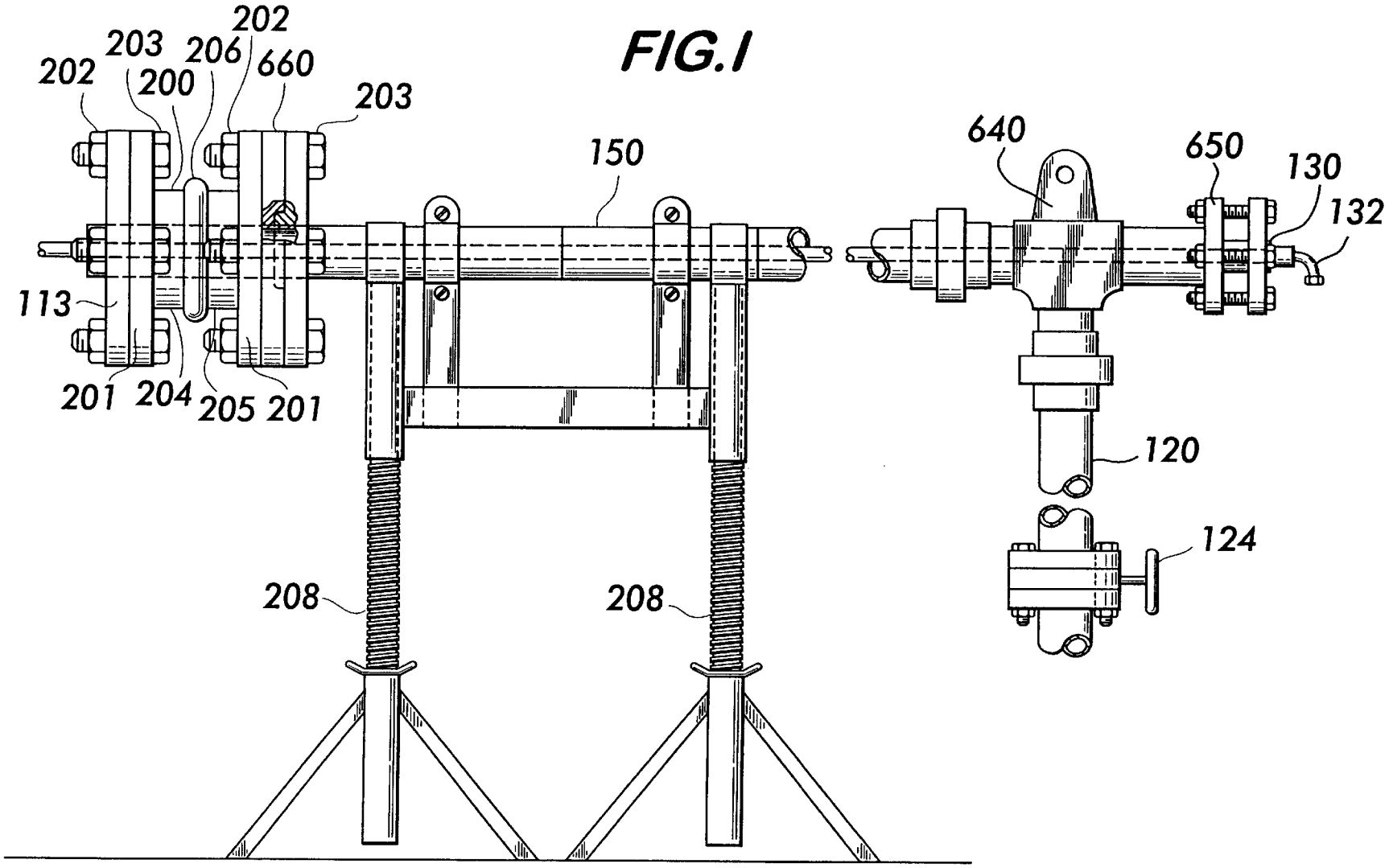
FIG. 1 is a schematic view, with parts broken away, illustrating the manner in which the apparatus of the present invention may be assembled so as to practice the process of the present invention.
Figure 2:
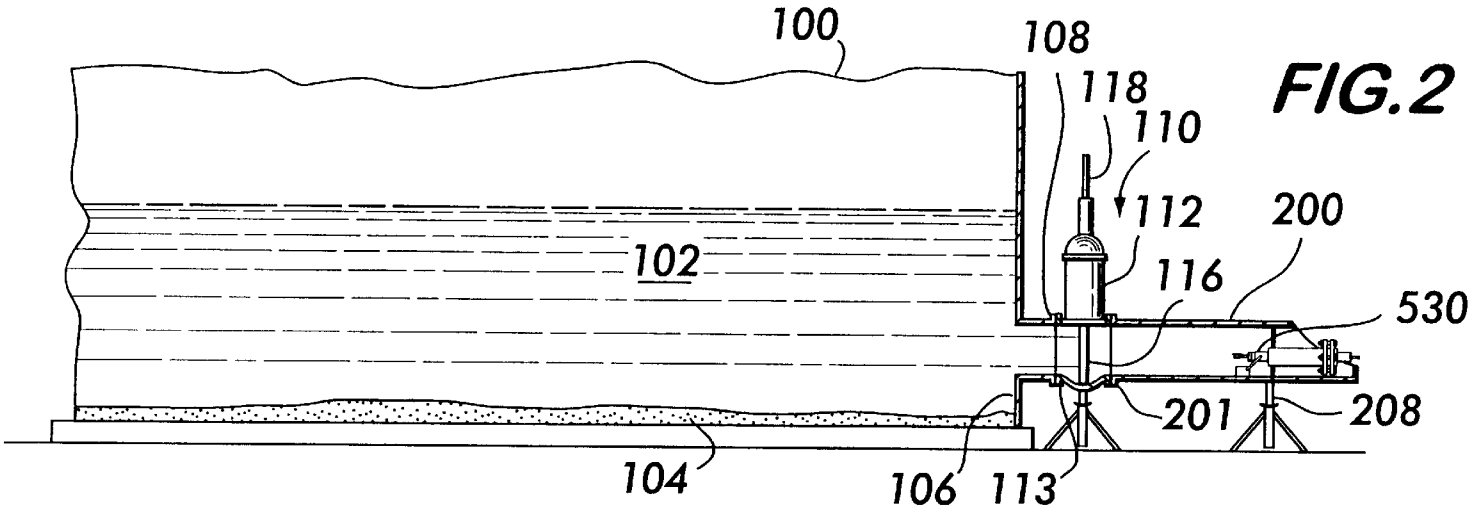
FIG. 2 is a sectional view showing a storage tank to which the apparatus of the present invention is connected.

In FIG. 2, there is shown a portion of a storage tank 100 provided with a manway 106 to which a gate valve 110 has been mounted in any suitable manner and to which an isolation barrel 200 has been secured in an suitable manner. FIG. 2 shows a typical means of securing isolation barrel 200 through the provision of manway flange 108 on manway 106, gate valve flanges 113 (FIG. 1) of gate valve 110 and isolation barrel flanges 201 (FIG. 1) on isolation barrel 200. The flanges 108, 113 and 201 being interconnected in any suitable manner such as through the provision of interconnecting nuts 202, bolts 203 and seals (not shown). Isolation barrel 200 includes a first end 204 and a second end 205 interconnected with a flexible coupling 206.

A hydraulic drive (not shown) mounted adjacent to the end of and in axial alignment with the isolation barrel 200 is used for inserting and removing the concentric pipe means of the present invention.

Figure 3:
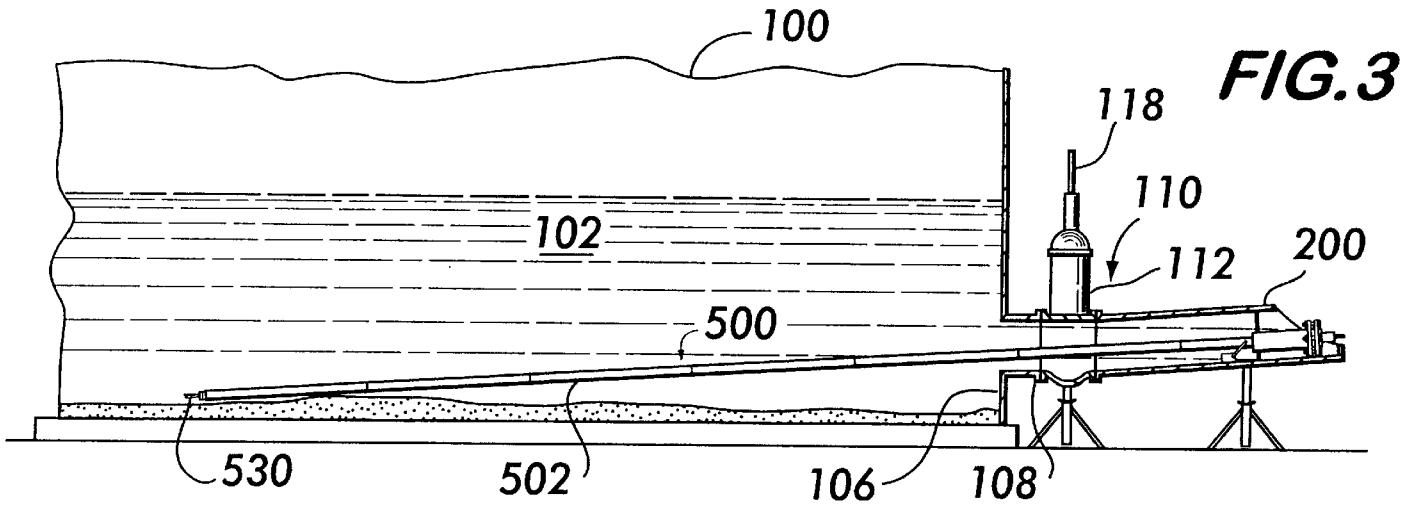
FIG. 3 is a sectional view showing a storage tank to which the apparatus of the present invention is connected with the concentric pipes extending inside the storage tank.

Turning now to FIGS. 2 and 3, there is shown a storage tank 100, such as a crude oil storage tank containing crude oil 102 and, as shown in FIG. 2, hydrocarbon sludge 104. The crude oil storage tank 100 is provided with a manway 106 such as a manway having a manway flange 108 on which a gate valve 110 is mounted in a manner described above. The gate valve 100 may be of any desired construction and may comprise, for example, a bonnet 112 and a base provided with flanges 113 into which a valve plate 116 may be raised and lowered by appropriate turning means such as turning bar 118.

Figure 7:
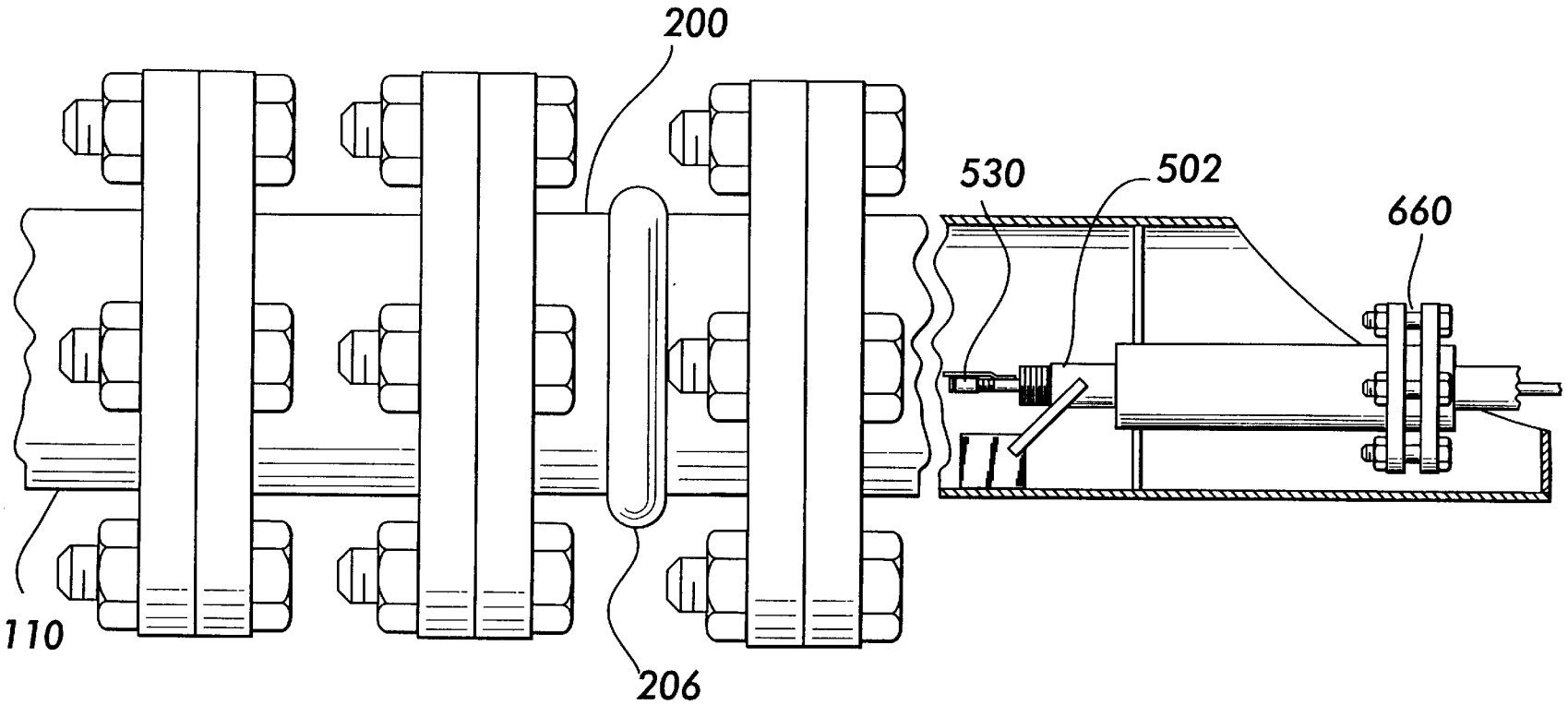
FIG. 7 is a side view, partially in section, of an isolation barrel constructed in accordance with the present invention.

A flanged isolation barrel 200, the details of construction of which are shown more clearly in FIG. 7, is appropriately mounted on the gate valve 110 and held in place by suitable means such as support 208.

Figure 4:
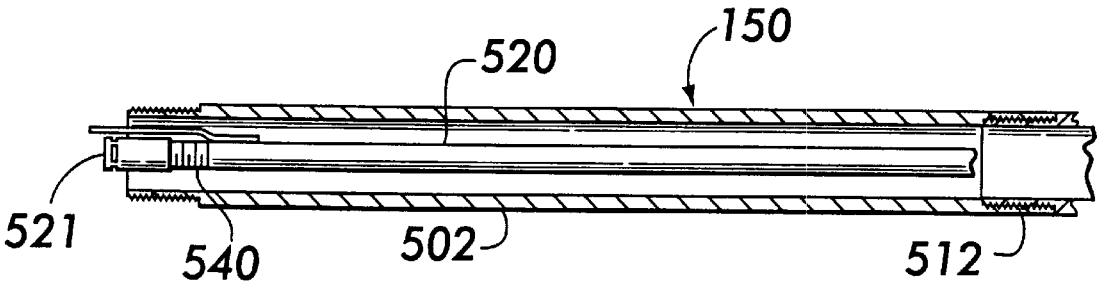
FIG. 4 is a sectional view of a concentric pipe.
Figure 5:
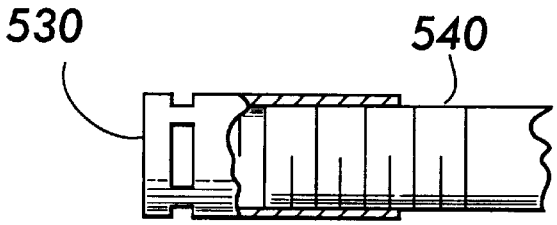
FIG. 5 is a sectional view of a spray means of the present invention.

Turning to FIG. 4, there is shown concentric pipes 150 utilized in the present invention comprising inner joints of pipe 520 and outer joints of pipe 502. The inner joints of pipe 520 and outer joints of pipe 502 form concentric pipe joints 150. Multiple concentric pipe joints 150 can be interconnected by any suitable means such as welding. The first inner joint of pipe 520 has affixed to its leading end 521 a spray nozzle 530 as shown in FIG. 5. Spray nozzle 530 is affixed to the inner joint of pipe 520 by means such as suitable tapered threads shown at 540.

The spray nozzle 530 may be of any suitable configuration to provide for sufficient removal of the sludge, which is to be fluidized in the tank. The spray nozzle 530 can be configured to deliver a range of spray patterns ranging from a narrow angle, full cone spray pattern (as provided by model G15 available from Spraying Systems Inc.) to a wide angle full cone spray pattern (as provided by nozzle H available from Spraying Systems Inc.), to a hallow cone or tank washing nozzles, such as model BST; or 6353 or 12900-1, respectively, available from Spraying Systems Inc.

Suitable pipe rack and assembly means such as a hydraulic drive (not shown) are provided to insert the concentric pipe joints. The hydraulic drive incorporates suitable gripping and moving means to allow the concentric pipes to be inserted into, manipulated within, and removed from the tank.

Figure 6:
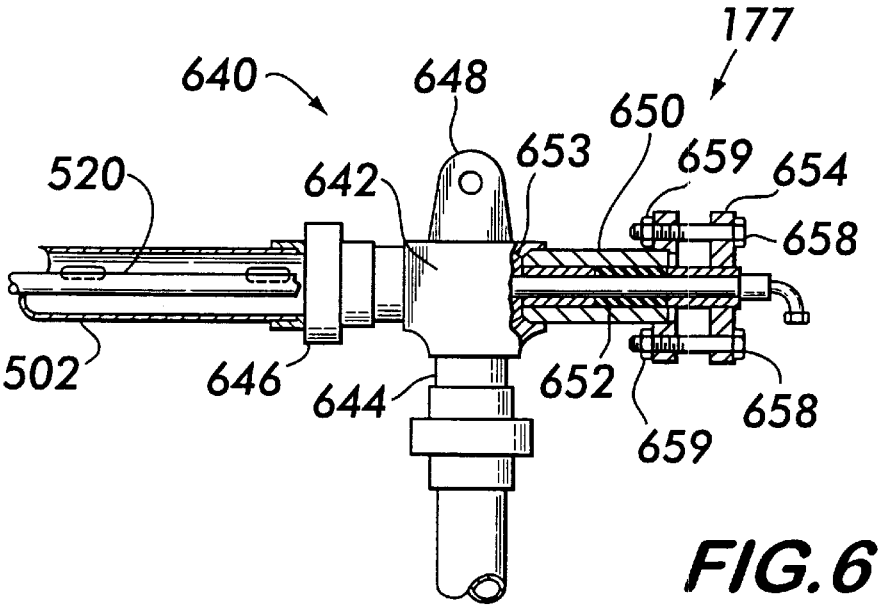
FIG. 6 is a side view, partially in section of the transition sub of the present invention.

When a concentric pipe means of a desired length has been formed; a transition sub 640 of the type shown in FIG. 6 may be interconnected with the rear most outer joint of pipe of the multi-joint assembly. The inner multi-joint pipe assembly extends through second packing gland 650 of transition sub 640.

With reference to FIG. 6, the transition sub 640 may comprise, for example, an elbow jointed tubular casing 642 from which a flanged elbow joint 644 extends. Elbow joint 644 is connected to a drain line conduit means such as drain pipe 120 provided with a drain outlet valve 124. Drain pipe 120 interconnects with a suitable disposal/recycling means (not shown) for the sludge material removed from storage tank 100. Suitable pipe coupling means are mounted on the front end of the tubular elbow-joint casing 642 such as pipe coupling means 646. A pipe support bracelet 648 may be provided, if desired, to support the transition sub while it is being positioned. The rear opening of the elbow joint tubular casing 642 is closed in accordance with the present invention with a first high pressure packing gland 650 in which a deformable packing 652 is mounted. The front end of the first high pressure tubular packing gland 650 being in bearing engagement with a metal packing ring 653 on which a metal packing gland tube bears. A flanged high pressure packing gland cover plate 654 is used to cover the rear open end of the high pressure tubular packing gland 650. The inner section of pipe 520 is inserted through the opening in the flanged high pressure packing gland 650 through the bore of the elbow-jointed tubular casing 642. Thereafter, the flanged high pressure packing gland cover plate 654 is secured to the flanges of the flanged high pressure tubular packing gland 650 by an appropriate means such as a plurality of flange bolts 658 which are tightened by means of flange nuts 659. Thus, the inner joint of pipe can be moved longitudinally, independent of the concentric outer joint of pipe. The rearmost 130 end of the inner joint of pipe is connected, as by a suitable swiveling elbow fitting 132 to a source of flushing fluid (not shown). The source of flushing fluid comprises suitable pump and tank storage means for supplying pressurized flushing fluid through the inner joint of pipe, through the spray nozzle and into the crude oil storage tank.

The outer joint of pipe extends through a second high pressure packing gland 660 mounted to isolation barrel 200. The design of the second high pressure packing gland 600 is of design as described above with respect to the first high pressure packing gland.

OPERATION

When a crude oil storage tank 100 containing crude oil and having an undesirable quantity of hydrocarbon sludge 104 accumulated in the bottom thereof is to be cleaned, a gate valve 110 is mounted on the manway 106 in any appropriate manner, such as for example, by bolting the gate valve to a manway flange. At the time of installation, the gate valve plate 116 will be in a closed position.

Isolation barrel 200 is mounted on the gate valve 110 as by bolting a flange 201 of the isolation barrel 112 to the flange of the gate valve 113. The second packing gland 660 is bolted to a flange 201 of the isolation barrel. Next supports 208 are oriented adjacent to second packing gland 660 and a hydraulic drive (not shown) is oriented adjacent to the supports 208 in axial alignment with isolation barrel 200.

A joint of concentric inner and outer pipes 150 is inserted through second packing gland 660. This inner joint of concentric pipe has spray assembly 530 mounted to the front most end 521. Bolts 203 and nuts 202 are tightened to provide a fluid tight seal between the second packing gland 660 and the outer joint of pipe 502. The hydraulic drive is employed to insert the concentric pipes into storage tank 100.

The rear most end of the concentric pipes is terminated with transition sub 640. Suitable connections are made through drain pipe 120 and drain pipe outlet valve 124, which is closed, to dispose of sludge removed from the storage tank. The rear most end of inner pipe, extending through the first high pressure packing gland 650 is terminated in swiveling elbow fitting 132 which is connected to a suitable source of high pressure flushing fluid.

Gate valve 110 is opened, and the hydraulic drive is used to insert the concentric pipes through the isolation barrel 200 and gate valve 110 into storage tank 100. The flexible coupling 206 of isolation barrel 200 allows adjustment of supports 208 to move the front end of the concentric pipes vertically and horizontally so as to be variably oriented within storage tank 100.

The source of high pressure flushing fluid is activated, forcing the flushing fluid into the sludge layer 104 within storage tank 100. Drain pipe outlet valve 124 is opened and the sludge removed either by natural flow or through the action of a suction pump (not shown).

The independently moveable nature of the inner pipe 520 and the outer pipe 502 coupled with the flexible coupling 206 of isolation barrel allows for significant variation in the orientation of spray nozzle 530 within the sludge layer 104 within storage tank 100. This allows the operator to remove significantly all of the sludge layer 104 from storage tank 100 through appropriate manipulation of the longitudinal orientation of the inner pipe and the outer pipe. To allow shorter sections of concentric pipes to reach all areas of a tank, multiple manways 106 can be spaced about the circumference of a storage tank 100.

When the sludge layer 102 has been reduced to an acceptable level, the concentric pipes can be withdrawn by the hydraulic drive, gate valve 116 closed and the apparatus removed for use on another storage tank, or moved to different manways on the same storage tank.

While the invention has been described with reference to particular embodiments thereof, it is apparent that numerous other forms and modifications of the invention will be obvious to those skilled in the art. The appended claims and this invention generally should be construed to cover all such obvious forms and modifications which are within the true scope and spirit of the present invention.

What is claimed is:

1. A method for redispersing and removing hydrocarbon sludge deposited in a crude oil storage tank containing crude oil and said hydrocarbon sludge, said method comprising the steps of:

mounting on said crude oil storage tank an access port including a gate valve, and an isolation barrel open to said gate valve at the front thereof and having an axially aligned first packing gland in the rear end thereof; and inserting a joint of concentric pipes through said first packing gland, said joint of pipes comprising an outer pipe open at a front end and, said joint of pipe further comprising an inter pipe extending through said outer pipe thereby forming an open annular region between said inner pipe and said outer pipe, said inner pipe having means to mount nozzles means at a front end, said inner pipe being freely movable in an longitudinal direction within said outer pipe; and mounting nozzle means at a front end of said inner pipe; and opening said gate valve to establish communication between the interior of said storage tank and the interior of said isolation barrel; and extending said concentric pipes through said packing gland, through said gate valve and into said crude oil storage tank whereby said outer pipe is movable within the interior of said storage tank; and connecting an outlet fitting to a rear end of said outer pipe, said outlet fitting allowing fluid flow, controlled by an outlet valve, there through from said open annular region, said outlet fitting having an axially aligned second packing gland through which said inner pipe extends; and fluidly interconnecting said inner pipe extending through said second packing gland to a source of pressurized flushing fluid; and fluidly interconnecting said outlet fitting to a waste disposal means; and forcing pressurized flushing fluid through said inner pipe, out said nozzle means at said front end of said inner pipe into the interior of said crude oil storage tank; and withdrawing hydrocarbon sludge intermixed with said flushing fluid from said outlet fitting which fluidly interconnects with the interior of said crude oil storage tank through said annular region and said open front end of said outer pipe; and manipulating said inner pipe and said outer pipe within said storage tank to redisperse and remove hydrocarbon sludge from said crude oil storage tank.

* * * * *